United States Patent [19]

Parise

[11] 4,122,579

[45] * Oct. 31, 1978

[54] STEAM CLEANER DUMP BUCKET

[75] Inventor: Carl Parise, Reno, Nev.

[73] Assignee: Parise & Sons, Inc., Reno, Nev.

[ * ] Notice: The portion of the term of this patent subsequent to Oct. 14, 1992, has been disclaimed.

[21] Appl. No.: 753,164

[22] Filed: Dec. 21, 1976

Related U.S. Application Data

[63] Continuation of Ser. No. 570,973, Apr. 23, 1975, abandoned, which is a continuation of Ser. No. 476,029, Jun. 3, 1974, Pat. No. 3,911,524.

[51] Int. Cl.[2] ..... A47L 7/00; A47L 9/10

[52] U.S. Cl. ..... 15/353; 15/320; 55/320

[58] Field of Search ..... 15/320, 321, 327 E, 15/352, 353, 327 D; 55/320, 331, 344, 424, 426, 437–439, 467

[56] References Cited

U.S. PATENT DOCUMENTS

| | | | |
|---|---|---|---|
| 3,029,463 | 4/1962 | Bishop | 15/353 |
| 3,774,260 | 11/1973 | Emus, Jr. | 15/321 |
| 3,896,521 | 7/1975 | Parise | 15/353 |
| 3,911,524 | 10/1975 | Parise | 15/321 |

*Primary Examiner*—Stuart S. Levy

*Attorney, Agent, or Firm*—Sughrue, Rothwell, Mion, Zinn and Macpeak

[57] ABSTRACT

For use with a steam cleaner, a dump bucket comprising upper and lower cup-shaped members releasably engageable in facing relationship with an air-tight seal, a hollow riser tube extending upwardly from an aperture in the bottom of the lower cup-shaped member, and an L-shaped connector for attachment to a steam cleaner vacuum wand extending first inwardly from the side of the upper cup-shaped member and then upwardly towards the inner surface of the top of the upper cup-shaped member. This configuration causes dirty water forced through the L-shaped connector to be sprayed against the inner surface of the top of the upper cup-shaped member, after which it runs down the sides of the upper and lower cup-shaped members without going down the riser tube.

1 Claim, 4 Drawing Figures

FIG. 1
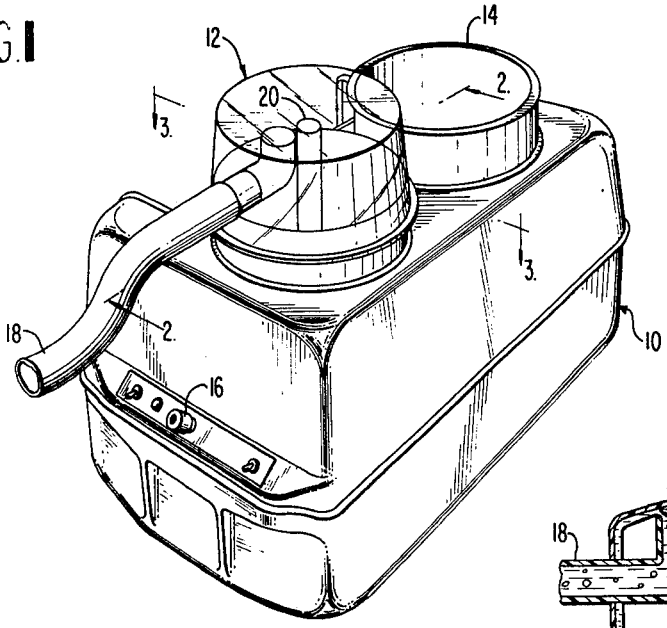
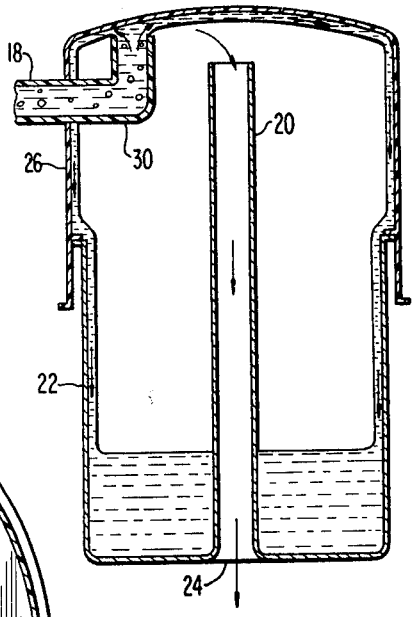
FIG. 4
FIG. 3
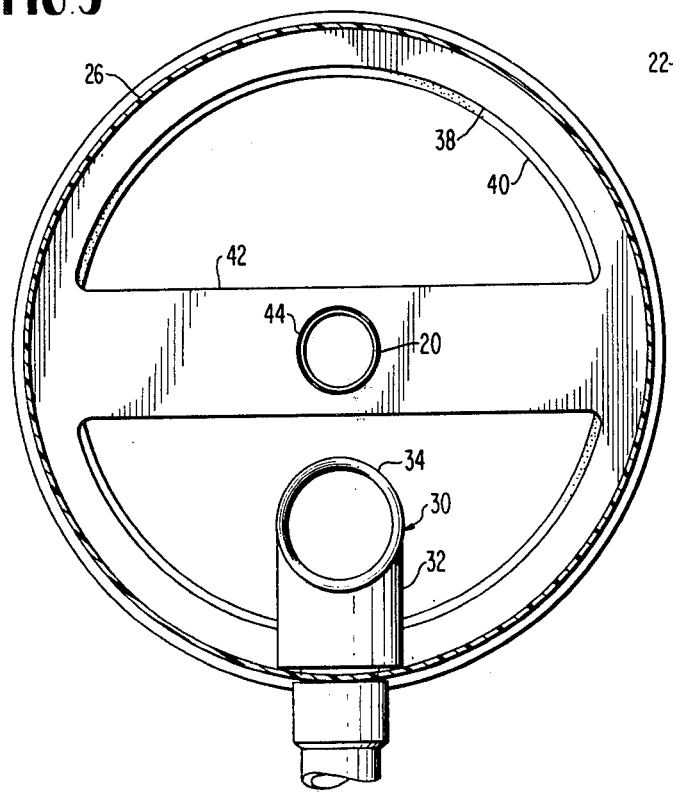

STEAM CLEANER DUMP BUCKET

This is a continuation of application Ser. No. 570,973, filed Apr. 23, 1975, now abandoned, which is a continuation of application Ser. No. 476,029 filed June 3, 1974, now U.S. Pat. No. 3,911,524.

FIELD OF THE INVENTION

This invention relates to what are conventionally called "steam cleaners," but which are cleaners which in fact generally cause atomized, detergent-containing hot water, rather than steam, to be sprayed on objects, such as rugs and other floor surfaces, to be cleaned. The hot water is then re-collected into a dump bucket by means of a vacuum wand. The present invention is of an improved new dump bucket for use with such a "steam cleaner."

SUMMARY OF THE INVENTION

The dump bucket according to the present invention comprises upper and lower cup-shaped members releasably engageable in facing relationship with an air-tight seal, a hollow riser tube extending upwardly from an aperture in the bottom of the lower cup-shaped member, and an L-shaped connector for attachment to a steam cleaner vacuum wand extending first inwardly from the side of the upper cup-shaped member and then upwardly towards the inner surface of the top of the upper cup-shaped member. This configuration causes dirty water forced through the L-shaped connector to be sprayed against the inner surface of the top of the upper cup-shaped member after which it runs down the sides of the upper and lower cup-shaped members without going down the riser tube.

BRIEF DESCRIPTION OF THE DRAWINGS

FIG. 1 is a perspective view of a steam cleaner employing a dump bucket built in accordance with the present invention.

FIG. 3 is a sectional top view of the presently preferred embodiment of the invention.

FIG. 4 is a schematical sectional side view of a dump bucket according to the present invention during use.

DETAILED DESCRIPTION OF THE PREFERRED EMBODIMENT

Figure 2:
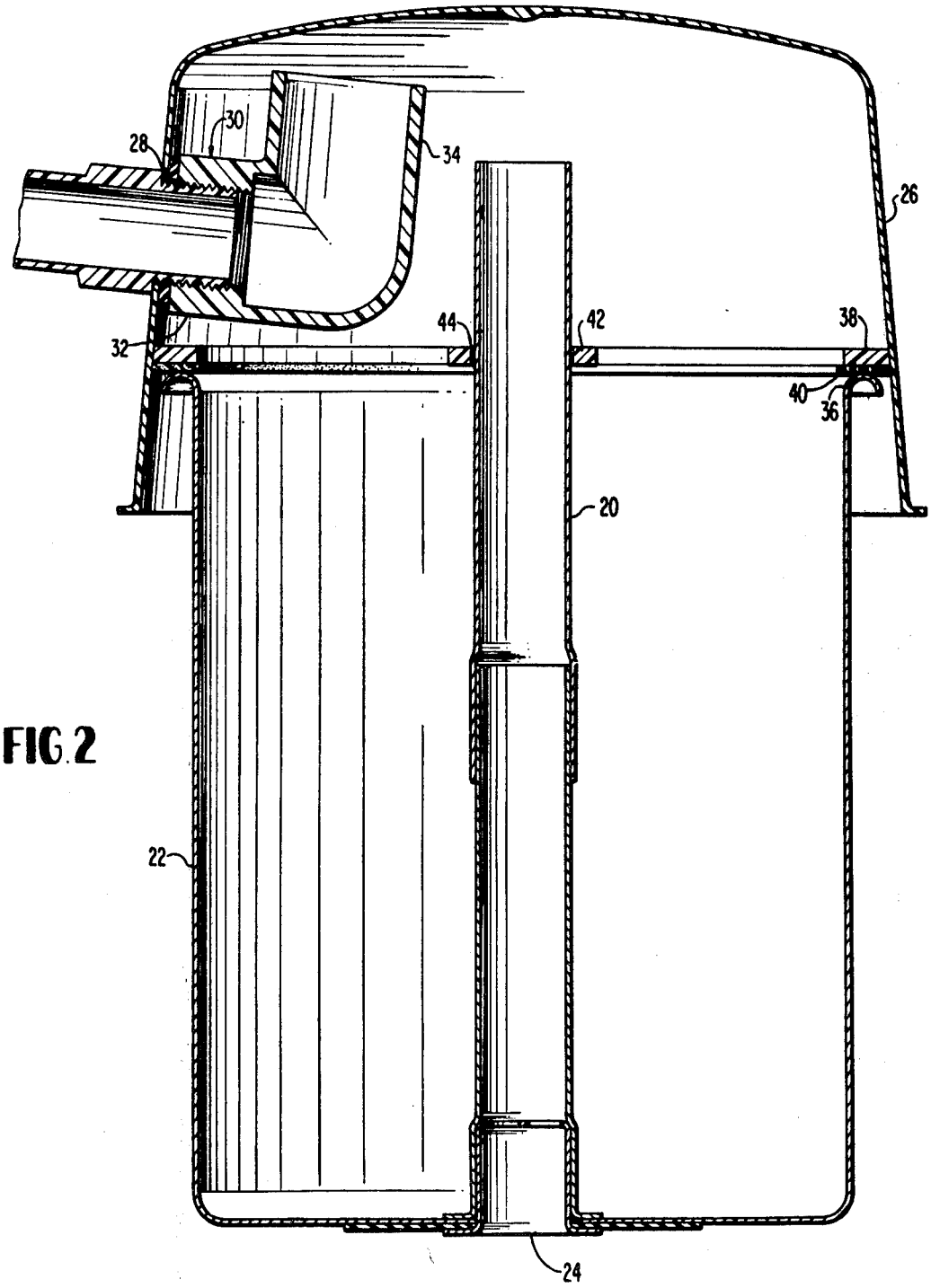
FIG. 2 is a sectional side view of the presently preferred embodiment of the invention.

FIG. 1 shows a steam cleaner 10 employing a dump bucket 12 built in accordance with the present invention. The operation of the steam cleaner 10 is briefly as follows. Water and detergent are placed in the soap tank 14. An immersion heater (not shown) mounted in the bottom of the soap tank 14 may be used to heat the detergent-containing water to an elevated temperature. An internal water pump (not shown) draws the detergent-containing water from an outlet at the bottom of the soap tank 14 and forces it out through a flexible tube (not shown) which may be coupled to the quick disconnect 16. An atomizer nozzle (not shown) at the end of the flexible tube causes the stream of detergent-containing water to issue from the flexible tube as a mist, commonly but not strictly accurately referred to as "steam." The mist may be directed at an object to be cleaned by the operator of the stream cleaner. Subsequently, the detergent-containing water and the entrained dirt are picked up by the vacuum wand 18. An internal vacuum pump (not shown) communicates with the interior of the dump bucket 12 via a hollow riser tube 20, creating an under pressure in the interior of the dump bucket 12. External air rushing through the vacuum wand 18 draws the detergent-containing water and the entrained dirt through the vaccum wand 18 and into the interior of the dump bucket 12.

The presently preferred embodiment of the dump bucket 12 is shown in detail in FIGS. 2 and 3. It comprises an upwardly open, lower, cup-shaped member 22 having an aperture 24 in its bottom. The aperture 24 is shown as centrally located, but that is more for esthetic than functional reasons. Extending upwardly from the aperture 24 is the previously mentioned hollow riser tube 20. Releasably engaging the open face of the lower cup-shaped member 22 in an air-tight seal is a downwardly open, upper, cup-shaped member 26. There is an aperture 28 in the side of the upper cup-shaped member 26, and an L-shaped hollow connector 30 is mounted in the aperture 28. A first leg 32 of the connector 30 extends inwardly from the aperture 28, and the second leg 34 extends upwardly from the first leg 32, stopping short of but in proximity to the inner surface of the top of the upper cup-shaped member 26.

The height of the riser tube 20 is to some extent arbitrary. However, the higher it extends, the more dirty water can be collected in the dump bucket 12 without running the risk of having the collected water run down the riser tube 20 into the vacuum pump. On the other hand, it is generally not desirable to collect water in the dump bucket 12 higher than the lip of the lower cup-shaped member 22 for the obvious reason that any water above that level will cascade out in an unrestrained fashion when the upper cup-shaped member 26 is removed from the lower cup-shaped member 22. Also, the riser tube 20 must not extend so close to the inner surface of the top of the upper cup-shaped member 26 that it extends into the turbulent flow of dirty water splashed against that surface by the connector 30 or some of that water will run down the inside of the riser tube 20 and get into the vacuum pump. Thus, the preferred embodiment of the subject dump bucket has a riser tube which extends upwardly past the lip of the lower cup-shaped member but stops well short of the inner surface of the top of the upper cup-shaped member 26.

In order to permit the operator of the steam cleaner 10 to gauge the level of dirty water in the dump bucket 12 without removing the upper cup-shaped member 26, at least a part of the upper cup-shaped member 26 is preferably made of transparent material. In the presently preferred embodiment, the entire upper cup-shaped member 26 is molded in one piece from transparent plastic.

As previously stated, the upper and lower cup-shaped members 22 and 26 must be releasably engageable in air-tight relationship, but the exact manner in which this is accomplished is to some extent arbitrary. In the preferred embodiment, this is accomplished by curling over the upper lip 36 of the lower cup-shaped member 22 to provide a bearing surface and providing a cooperating inwardly extending annular shelf 38 mounted on the inner surface of the side of the upper cup-shaped member 26. A resilient annular seal, or O-ring, 40 is fixed to the bottom surface of the annular shelf 38 to ensure an air-tight seal between the two cup-shaped members. The upper cup-shaped member 26 fits over the upper lip 36 of the lower cup-shaped member 22, and the annular seal 40 receives the upper lip 36 in an air-tight seal.

While the dump bucket 12 may be built with only the parts described up to this point, it has been found convenient in practice to provide it with an additional member for strengthening the upper cup-shaped member 26 and for locating the upper cup-shaped member 26 relative to the lower cup-shaped member 22. That additional member is the flat strut 42, which is preferably fabricated integrally with the annular shelf 38. It extends diametrically across the upper cup-shaped member 26, and an aperture 44 therein receives the upper end of the riser tube 20, locating the upper cup-shaped member 26 relative to the lower cup-shaped member 22. This locating function serves to ensure that the upper lip 36 of the lower cup-shaped member 22 engages the annular seal 40 in the same place every time, ensuring an air-tight seal even after a groove has been worn in the annular seal 40.

Having described the construction of the preferred embodiment of the present invention in some detail, I will now describe the operation of my dump bucket with the aid of the partially schematic FIG. 4, which shows a dump bucket according to the present invention during use. At this time, vacuum is applied to the aperture 24, in effect "sucking" air through the vacuum wand 18 and down the riser tube 20. The rush of air through the vacuum wand 18 picks up dirty water, which is forced through the L-shaped connector 30 and sprayed against the inner surface of the top of the upper cup-shaped member 26. There, the air and the dirty water separate to a large degree, the air rushing into the riser tube 20 and the water running down the side of the upper cup-shaped member 26, over the annular joint between the upper and lower cup-shaped members, and down the side of the lower cup-shaped member 22 to its bottom, where it collects. The dump bucket 12 is, of course, removable from the steam cleaner 10, and when the desired amount of cleaning is completed or the level of water in the lower cup-shaped member 22 approaches its lip, the dump bucket 12 may be removed from the steam cleaner 10, the upper cup-shaped member 26 disengaged from the lower cup-shaped member 22, and the contents of the latter dumped.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

What is claimed is:

1. A dump bucket for a steam cleaner, said dump bucket comprising:

an upwardly open, lower, cup-shaped member having an aperture in the bottom thereof;

a hollow riser tube fixed to the bottom of said lower cup-shaped member, being open to said aperture and extending upwardly therefrom to a height above the open top of said lower cup-shaped member;

a downwardly open, upper cup-shaped member, said upper cup-shaped member having an aperture in the side thereof;

an inwardly extending annular shelf carried by said upper cup-shaped member on the inner side surface of said upper cup-shaped member above said lower cup-shaped member, extending the full circumference of said upper cup-shaped member and contacting said lower cup-shaped member in an air-tight seal;

an L-shaped hollow connector, means for mounting said L-shaped hollow connector to the wall of the upper cup-shaped member with a first leg of which extending inwardly from said aperture in said upper cup-shaped member and a second leg of which extends upwardly from said first leg stopping short but in proximity to the inner surface of the top of said upper cup-shaped member; and strut means extending across said upper cup-shaped member from one portion of said annular shelf to another portion thereof and being integral therewith, said strut means intersecting said riser tube and being apertured to receive the upper end of said riser tube;

whereby, if vacuum is applied to the aperture in said lower cup-shaped member and a steam cleaner vacuum wand is connected to the exterior end of said first leg of said L-shaped hollow connector, dirty water will forced through said L-shaped hollow connector and sprayed against the inner surface of the top of said upper cup-shaped member, after which it will run down the sides of said upper and lower cup-shaped members without going down said hollow riser tube.

* * * * *